US010285887B2

(12) United States Patent
Woolway

(10) Patent No.: US 10,285,887 B2
(45) Date of Patent: May 14, 2019

(54) APPARATUS FOR RISING TO A SITTING POSITION UTILIZING A LEG ANCHOR

(71) Applicant: FootAnchor LLC, State College, PA (US)

(72) Inventor: Allan Woolway, State College, PA (US)

(73) Assignee: FootAnchor LLC, State College, PA (US)

( * ) Notice: Subject to any disclaimer, the term of this patent is extended or adjusted under 35 U.S.C. 154(b) by 0 days.

(21) Appl. No.: 15/962,008

(22) Filed: Apr. 25, 2018

(65) Prior Publication Data

US 2018/0318159 A1 Nov. 8, 2018

Related U.S. Application Data

(60) Provisional application No. 62/502,738, filed on May 7, 2017.

(51) Int. Cl.
*A61G 7/053* (2006.01)
*A47C 31/00* (2006.01)
(Continued)

(52) U.S. Cl.
CPC ..... *A61G 7/053* (2013.01); *A47C 31/00* (2013.01); *A61G 5/14* (2013.01); *A61G 7/0533* (2013.01); *A63B 21/00* (2013.01); *A63B 23/00* (2013.01); *A63B 23/0211* (2013.01); *A63B 2022/0038* (2013.01)

(58) Field of Classification Search
CPC .... A61G 7/053; A61G 7/0533; A61G 7/0536; A61G 5/14; A47C 21/00; A47C 31/00; A63B 21/00; A63B 23/00; A63B 23/0205; A63B 23/0211; A63B 2022/0038
See application file for complete search history.

(56) References Cited

U.S. PATENT DOCUMENTS 3,134,592 A * 5/1964 Sharkey ..... A63B 23/0211 482/140
4,378,939 A * 4/1983 Wild ..... A63B 21/1672 482/140

(Continued)

FOREIGN PATENT DOCUMENTS

JP 2010162196 A 10/2013

OTHER PUBLICATIONS

Stander, Bed Caddie, ArthritisSupplies.com, https://www.arthritissupplies.com/bed-caddie.html; 2018, 1, The Wright Stuff, Inc. UK.

*Primary Examiner* — Robert G Santos
*Assistant Examiner* — David R Hare
(74) *Attorney, Agent, or Firm* — Michael S. Walters; Penn State Law IP Clinic

(57) ABSTRACT

A sit-up apparatus comprises at least a foot anchor rod and a base plate. The base plate is disposed underneath a mattress (or other surface, such as a couch) and positioned adjacent to an edge of the mattress, with the foot anchor rod extending outward horizontally (and positioned somewhat below the top surface of the mattress). In several embodiments, a base connecting rod interconnects the base plate and the anchor rod, providing separation between the two. In use, an individual is able to position a foot underneath the foot anchor rod and quickly rise into a sitting position.

14 Claims, 5 Drawing Sheets

(51) Int. Cl.

| | |
|---|---|
| ***A61G 5/14*** | (2006.01) |
| ***A63B 21/00*** | (2006.01) |
| ***A63B 23/02*** | (2006.01) |
| ***A63B 23/00*** | (2006.01) |
| *A63B 22/00* | (2006.01) |

(56) References Cited

U.S. PATENT DOCUMENTS 4,515,361 A * 5/1985 Melillo ..... A63B 23/0211 482/140
4,550,907 A * 11/1985 Melillo ..... A63B 23/0211 482/140
4,679,788 A * 7/1987 Adler ..... A63B 21/0615 482/108
4,843,661 A * 7/1989 Skibinski ..... A61G 7/1038 5/81.1 HS
4,925,184 A * 5/1990 McJunkin, Jr. .... A63B 22/0605 482/60
4,932,090 A * 6/1990 Johansson ..... A47K 17/024 5/662
5,160,306 A * 11/1992 Lui ..... A63B 23/0211 482/140
5,207,628 A * 5/1993 Graham ..... A63B 23/0211 482/140
5,337,430 A * 8/1994 Schlein ..... A47C 21/00 5/662
5,354,022 A * 10/1994 Coonrod ..... A61G 7/053 248/127
5,400,450 A * 3/1995 Leoutsakos ..... A47C 21/08 5/426
5,435,028 A * 7/1995 Frala ..... A61G 7/053 135/66
5,448,791 A * 9/1995 Brown ..... A47C 21/00 5/425
5,471,689 A * 12/1995 Shaw ..... A47C 21/08 5/426
5,787,530 A * 8/1998 Brix ..... A61G 7/053 5/424
5,820,532 A * 10/1998 Oliver ..... A63B 21/055 482/123
5,916,085 A 6/1999 Wells
6,044,507 A * 4/2000 Smith ..... A61G 7/1038 248/158
6,134,731 A * 10/2000 Thom ..... A61G 7/0507 5/424
6,244,285 B1 * 6/2001 Gamache ..... A47C 21/08 135/66
6,276,007 B1 8/2001 Brown
6,615,432 B1 * 9/2003 Blaylock ..... A61G 7/053 5/662
6,629,325 B2 * 10/2003 Heavrin ..... A61G 7/053 5/662
6,813,789 B2 * 11/2004 Leoutsakos ..... A47C 19/02 5/424
7,163,497 B2 * 1/2007 Spinosa ..... A63B 23/0211 482/140
7,172,540 B2 * 2/2007 Nguyen ..... A63B 23/0211 482/140
7,234,182 B2 * 6/2007 Miller ..... A47C 21/00 5/507.1
7,373,679 B2 * 5/2008 Miller ..... A47C 21/08 5/426
7,472,445 B2 * 1/2009 Miller ..... A47C 21/00 5/652
7,805,789 B1 * 10/2010 Dean ..... A61G 7/053 5/646
7,862,122 B1 * 1/2011 Shammas ..... B60N 2/245 297/411.23
8,919,362 B1 * 12/2014 Mortenson ..... A45B 9/04 135/66
10,130,838 B2 * 11/2018 Murrell ..... A63B 23/0211
2004/0181877 A1 * 9/2004 Miller ..... A47C 21/00 5/622
2006/0223683 A1 * 10/2006 Orona ..... A63B 21/04 482/96
2007/0186348 A1 * 8/2007 Banks ..... A61G 7/0533 5/662
2016/0310340 A1 * 10/2016 Heidingsfelder-Bongard ..... A61G 7/053

* cited by examiner

APPARATUS FOR RISING TO A SITTING POSITION UTILIZING A LEG ANCHOR

CROSS-REFERENCE TO RELATED APPLICATIONS

This application claims the benefit of U.S. Provisional Application Ser. No. 62/502,738, filed May 7, 2017 and herein incorporated by reference.

TECHNICAL FIELD

The present invention relates to an apparatus for assisting a person in rising to a sitting position from a prone position and, more particularly, to an apparatus where an individual can use a foot anchoring device to assist in moving to a sitting position.

BACKGROUND OF THE INVENTION

Many people with disabilities or injuries experience significant difficulty in getting up from a bed, day bed, lounge chair, or any other piece of furniture where an individual may be resting in a substantially prone position. While there exist several types of side rail devices (such as common on a hospital bed) and hand-assist devices that provide a type of handle for an individual to grip and assist in raising to a sitting position, there remain people who have issues with using their arms, or may have shoulder and/or back problems that prevent them from grasping a device to aid in rising to a sitting position.

Thus, a need remains for an apparatus that enables an individual to rise into a sitting position from a prone position without needing to use their arms, or shoulder/back muscles.

SUMMARY OF THE INVENTION

The needs remaining in the prior art are addressed by the present invention, which relates to an apparatus for assisting a person in rising to a sitting position from a prone position and, more particularly, to an apparatus where an individual uses a foot anchoring device to assist in moving to a sitting position, such as when getting up from lying in bed.

In accordance with one or more embodiments of the present invention, the apparatus comprises at least a foot anchor rod and a base plate. The base plate is disposed underneath a mattress (or other surface, such as a couch cushion) and positioned adjacent to an edge of the mattress, with the foot anchor rod extending outward horizontally (and positioned somewhat below the top surface of the mattress). In use, an individual is able to position a foot underneath the anchor rod and quickly rise into a sitting position from a prone position (such as when lying in bed).

In various embodiments of the present invention, the apparatus further comprises a base connecting rod attached between an end termination of the base plate and the foot anchor rod. The base connecting rod may be adjustable in height, allowing an individual to position the foot anchor rod at a height that provides maximum leverage in performing the movement to a sitting position. In some cases, a separate extension rod may be attached to the base connecting rod to provide additional height adjustment (preferable for use with today's tall mattresses).

In various embodiments of the present invention, the foot anchor is attached to the base connecting rod via a swivel connection, enabling the apparatus to be disposed along either side of the mattress.

Moreover, preferred embodiments of the present invention enable the foot anchor rod to rotate 360° (against and parallel to the side of the mattress or cushion) when not in use. For these embodiments, an individual is generally able to rotate the foot anchor rod into the "open" position by using his/her foot (or hand) to easily rotate the anchor rod from the closed to open position.

A specific embodiment of the present invention takes the form of a sit-up apparatus including a base plate configured to be disposed and remain in place underneath a surface upon which an individual may rest (the base plate of dimensions sufficient to remain in place while being used) and a foot anchor rod coupled to the base plate and disposed to extend outward and away from the base plate, the foot anchor rod disposed slightly below the individual in a manner such that an individual is able to rise to a sitting position by locating a foot underneath the foot anchor and pulling against with an ankle-area force (as in performing a sit up with someone holding down their legs). For the purposes of the present invention, the term "ankle-area" is defined as an area encompassing ±6 inches along a person's leg as measured from the ankle joint. Thus, it is to be understood that an individual may push against the inventive sit-up apparatus with an area of the top of the foot approaching his/her toes, or alternatively, push against the apparatus with an area of the top of the lower leg (such as near the calf). The term "ankle-area" is considered to define this entire range of physical contact with the foot anchor rod.

Other and further embodiments of the present invention will become apparent during the course of the following discussion and by reference to the accompanying drawings.

BRIEF DESCRIPTION OF THE DRAWINGS

Referring now to the drawings, where like numerals represent like parts in several views.

DETAILED DESCRIPTION

Many people have issues with pain or muscular weakness in their shoulders, neck and back. As a result, these people experience great difficulty in getting up from a prone (or reclining) position into a sitting position. The apparatus of the present invention has been designed to assist in getting up without the use of your arms or shoulders. The apparatus includes a component that swings out from the bed, chair or lounge (by using your foot) and lets a person tuck their foot under an "anchor rod" to assist in sitting up. Because of the strength most people have in their legs, the movement from a prone position to sitting position becomes an easy task when using the foot anchor rod.

In accordance with the principles of the present invention, the apparatus is configured to work from either side of a bed, chair, lounge (or the like) and swings out on a simple, easy-to-use swivel. When not needed, the anchor rod swivels against the bed out of the way. As will be discussed in detail below, the apparatus may further comprise an adjustable columnar rod (attached between a base plate and the foot anchor rod) that allows for the position of the anchor to be adjusted with respect to the top of the mattress. The adjustable rod may comprise telescoping elements, a screw sleeve that provides for a lengthening (or shortening) of the associated rod, or any other type of adjustment mechanism that provides the ability to control the position of the anchor rod with respect to the base.

The premise of the inventive apparatus can be likened to trying to do a sit-up without someone holding your legs. It is very difficult to perform this maneuver, which is the same reason why getting up out of bed without your feet being anchored is difficult. Without realizing it, people roll over on their side, bending their back, and push up with the arms and shoulders. What happens to the many people who have bad shoulders and can't push up, they need to roll out of bed and hope their feet hit the ground like a cat. This could be dangerous because of slipping or putting too much pressure on shoulder joints and muscles causing further injury.

Figure 1:
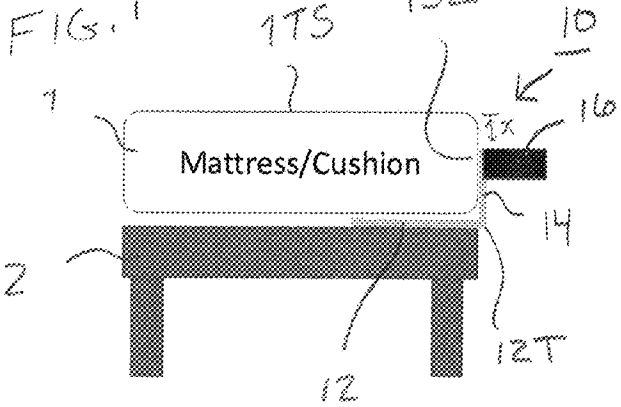
FIG. 1 is a simplified diagram illustrating the principles of the present invention.

FIG. 1 is a simplified end-view drawing of a bed, depicting a sit-up apparatus 10 formed in accordance with the present invention. Here, sit-up apparatus 10 is shown as positioned in place between a mattress 1 and a support surface 2 (where support surface 2 may comprise a bed frame, box spring, platform, or the like). During the course of the following discussion, while reference is made to a "mattress", it is to be understood that sit-up apparatus 10 may be used with any type of furniture that allows one to lay in a somewhat reclined position, as long as the furniture includes an interface (e.g., gap between the mattress and box spring, surface of couch underneath a cushion, etc.) for insertion of the base portion of apparatus 10. As shown in the embodiment of the invention illustrated in FIG. 1, exemplary sit-up apparatus 10 comprises a base plate 12, a base connecting rod 14, and a foot anchor rod 16. The various components are positioned and adjusted such base plate 12 is disposed between mattress 1 and box spring 2, with an end termination 12T of base plate 12 visible along a side edge 1SE of mattress 1. Base connecting rod 14 is shown as positioned against side edge 1SE, and foot anchor rod 16 is positioned perpendicular to base connecting rod 14 (that is, foot anchor rod 16 extends in a horizontal direction away from mattress 1). As will be discussed below, foot anchor rod 16 is preferably positioned a predetermined distance x below a top surface 1TS of mattress 1. The separation between top surface 1TS and foot anchor rod 16 provides the leverage a given individual requires in order to move from the prone to the sitting position (or vice versa).

Figure 2:
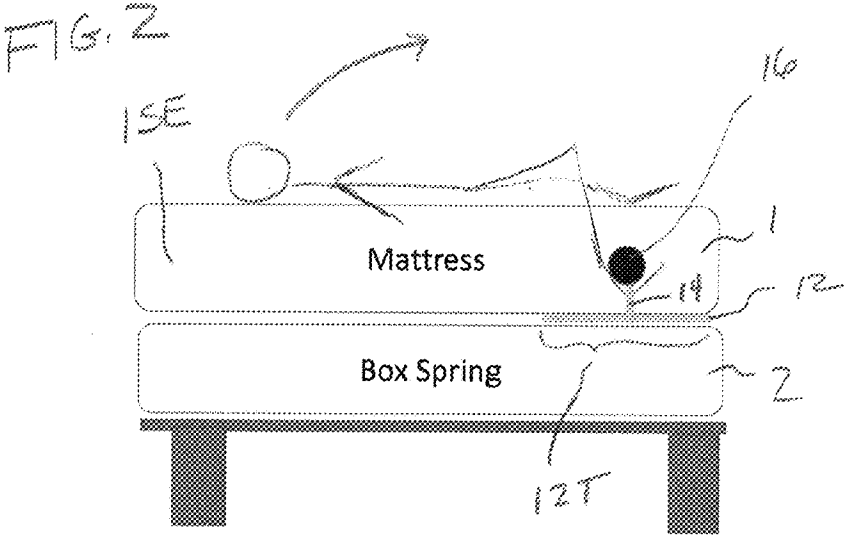
FIG. 2 is a side view of the diagram of FIG. 1, showing how an individual is able to locate their foot underneath the foot anchor rod and rise to a sitting position.
Figure 3:
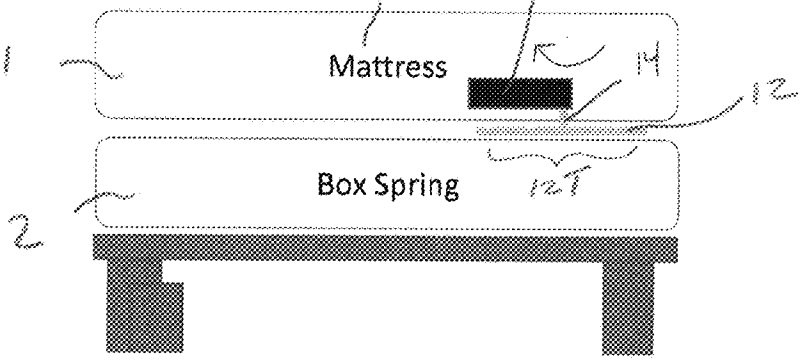
FIG. 3 shows the same view as FIG. 2, illustrating in this case the foot anchor rod rotated into its "closed" position against the bed.

In use, a person tucks the top of a foot underneath foot anchor rod 16 so that their ankle rests against foot anchor rod 16 (in general, an "ankle-area" contact, as defined above). In this position, the individual is then able to pull against rod 16 and rise into a sitting position. FIG. 2 is a simplified side view illustration of a bed, showing an individual lying prone on mattress 1, and positioning his/her ankle underneath foot anchor rod 16 of sit-up apparatus 10. The ability to rise from a sitting position from a prone position is indicated by the arrow in FIG. 2. FIG. 3 illustrates the same view as shown in FIG. 2, in this case showing foot anchor rod 16 rotated (swiveled) to rest against mattress side 1SE. The ability to move foot anchor rod 16 so as to be adjacent to a bed (instead of pointing outward) is considered to reduce the possibility of injury when an individual is walking alongside a bed using the inventive sit-up apparatus.

Figure 4:
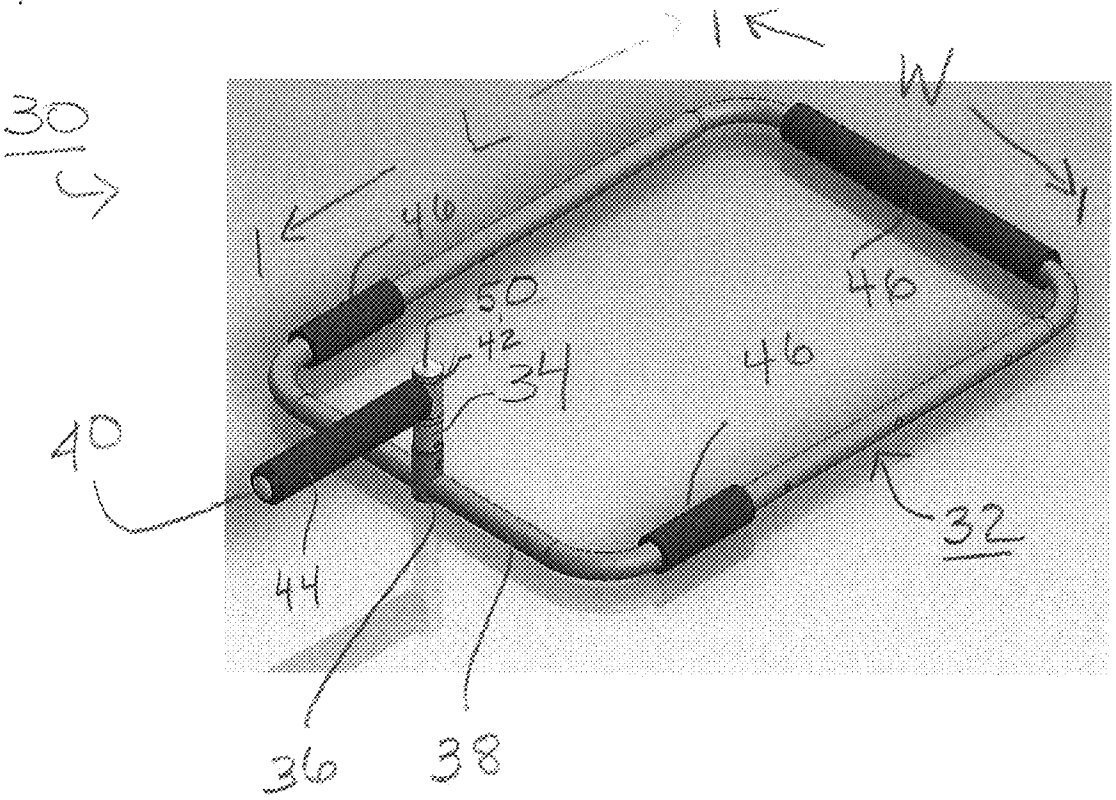
FIG. 4 is an isometric view of an exemplary embodiment of the present invention.

FIG. 4 is an isometric view of an exemplary sit-up apparatus 30 formed in accordance with the principles of the present invention. In this embodiment, a base 32 of apparatus 30 comprises a tubular structure of sufficient length L and width W to remain in position between a mattress (or any type of pad) and a supporting surface (such as a box spring or bed platform, for example). Sit-up apparatus 30 further comprises a base connecting rod 34 extending upward from a mid-point 36 of a first side edge 38 of base 32. A foot anchor rod 40 is shown as attached to an opposing end termination 42 of base connecting rod 34.

In the particular configuration shown in FIG. 4, base 32 is shown as being rectangular in form. It is to be understood that this is only one specific geometry and in general any suitable shape may be used (e.g., circular, oval, triangular, rectangular, or the like). Also, foot anchor rod 40 is shown in FIG. 4 as covered by a cushioning member 44, for adding comfort to the user. It is preferred that cushioning member 44 exhibit a non-slip exterior so that an individual's ankle area will remain in place underneath anchor rod 40 during use. Additional non-slip elements 46 are shown as disposed at various locations around the tubular member forming base 32. Again, the addition of non-slip elements 46 are thought to provide further assurance that sit-up apparatus 30 will be held in place underneath a mattress while in use. It is to be understood that while it is important for the inventive sit-up apparatus to remain in place during use, another advantage is that it is portable and relatively lightweight, allowing for the apparatus to be moved from one location to another, as needed.

In a preferred embodiment of the present invention, the foot anchor rod is attached to the base connecting rod via a swivel-type attachment. Shown in FIG. 4 as a swivel joint 50, this type of attachment allows for foot anchor rod 40 to be rotated into a "closed" position against the bed when not in use (as depicted in the diagram of FIG. 3). In one example, foot anchor rod 40 may be rotated horizontally, as shown in FIG. 3, and remain parallel to base 32. Alternatively, swivel 50 may be configured to rotate foot anchor rod 40 through a vertical movement, bringing foot anchor rod downward and adjacent to base connecting rod 34 (not depicted specifically in the drawings). In either case, it is a relatively easy maneuver to "open" sit-up apparatus 30 such that foot anchor rod 40 extends outward from the bed, in the manner described above.

Figure 5:
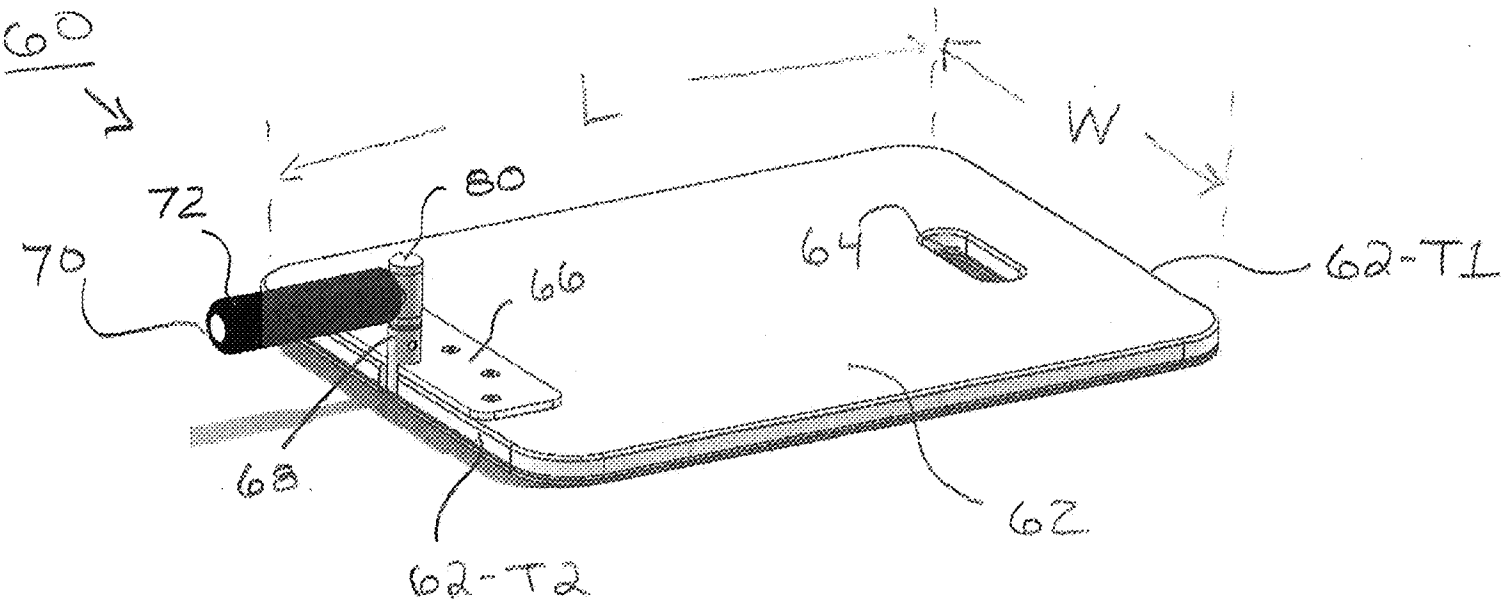
FIG. 5 is an isometric view of an alternative embodiment of the present invention, in this case using a base member formed of a solid piece of material.

FIG. 5 illustrates an alternative embodiment of the present invention. Here, a sit-up apparatus 60 is shown as comprising a solid base member 62 (instead of the tubular structure described above in association with FIG. 4). Again, base member 62 is formed of a length L and width W sufficient to provide the necessary stability for maintaining sit-up apparatus 60 in place during use (and may comprise any suitable shape: rectangular, oval, circular, etc.). For ease of transport, exemplary solid base member 62 is shown as including a grip opening 64 disposed near a first end germination 62-T1 of base member 62. Sit-up apparatus 60 further includes, in this particular example, a bracket 66 attached at a centered location of a second, opposing end termination 62-T2 of base member 62. A base connecting rod 68 is attached to bracket 66, with a foot anchor rod 70 attached to an opposing end termination of base connecting rod 68.

It is to be understood that foot anchor rod 70 may be attached to base connecting rod 68 via a swivel attachment 80, similar to swivel attachment 50 described above. When attached via such a swivel element, foot anchor rod 70 may be moved between an "open" and "closed" position such that it is moved to be adjacent to the bed (i.e., "closed") when not in use and eliminate the possibility for an individual to bump into the foot anchor rod. Again, foot anchor rod 70 preferably includes a non-slip, cushioned outer sleeve/surface 72, for ease of use. One or more non-slip members (not shown) may be disposed on the underside of base member 62 to assist in base member 62 being able to "grip" the adjacent surface below.

As mentioned above, base connecting rod component of the inventive sit-up apparatus may be adjustable in form, allowing for the separation between the base plate and the foot anchor rod to be modified in accordance with the user's preference. This is particularly useful inasmuch as various mattresses and cushions are of different thicknesses and the position of the foot anchor rod with respect to the top surface of the mattress factors into the amount of leverage that is provided.

Figure 6:
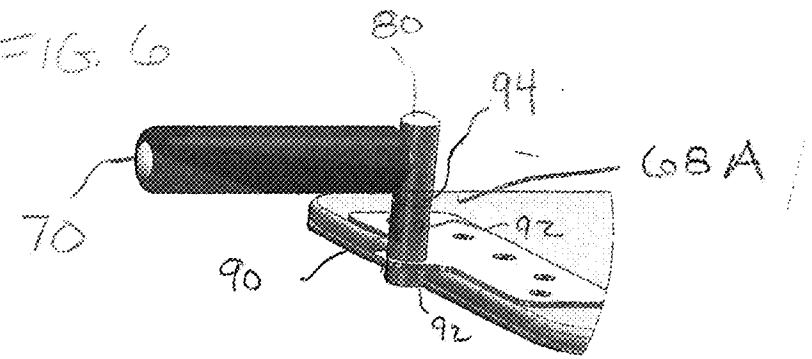
FIG. 6 is an enlarged view of an end termination of an exemplary sit-up apparatus of the present invention, in this case including an adjustable base connecting rod (used to adjust the spacing between the base plate and the foot anchor rod)

FIG. 6 is an enlargement of a portion of the embodiment of FIG. 5, depicting in this case an adjustable base connecting rod 68A. In this particular embodiment, base connecting rod 68A is formed as a two-piece telescoping configuration, with a lower portion 90 include a set of apertures 92 that extend vertically upward, and an upper portion 94 that fits within lower portion 90. Upper portion 94 is formed to include a spring-loaded pin that will then mate with a particular aperture 92 that provides the desired positioning of foot anchor rod 70 with respect to a mattress top surface (not shown).

Figure 7:
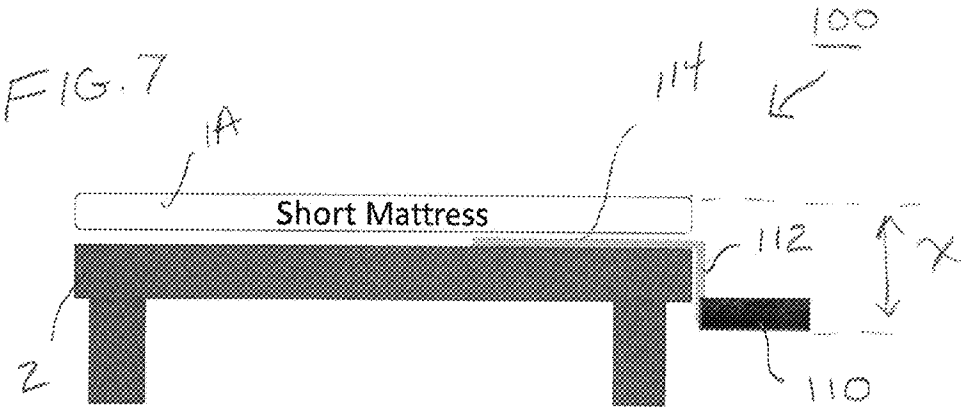
FIG. 7 is a diagram illustrating an exemplary situation where a sit-up apparatus of the present invention is configured for use with a thin mattress.

There may be circumstances where the sit-up apparatus of the present invention is used with an extremely thin mattresses/pad, where the foot anchor rod as configured in the above-described embodiments would inevitably extend above the mattress, regardless of the position of the base connecting rod. An alternative embodiment of the present invention, shown as sit-up apparatus 100 in FIG. 7, is useful in this situation where sit-up apparatus 100 is used in combination with a thin mattress 1A. In this embodiment, sit-up apparatus 100 comprises a foot anchor rod 110 that is attached to a base connecting rod 112 such that foot anchor rod 110 is disposed below a base plate 114. This configuration will thus create a sufficient spacing x to allow for an individual laying on thin mattress 1A to gain enough leverage to rise from a prone position.

Figure 8:
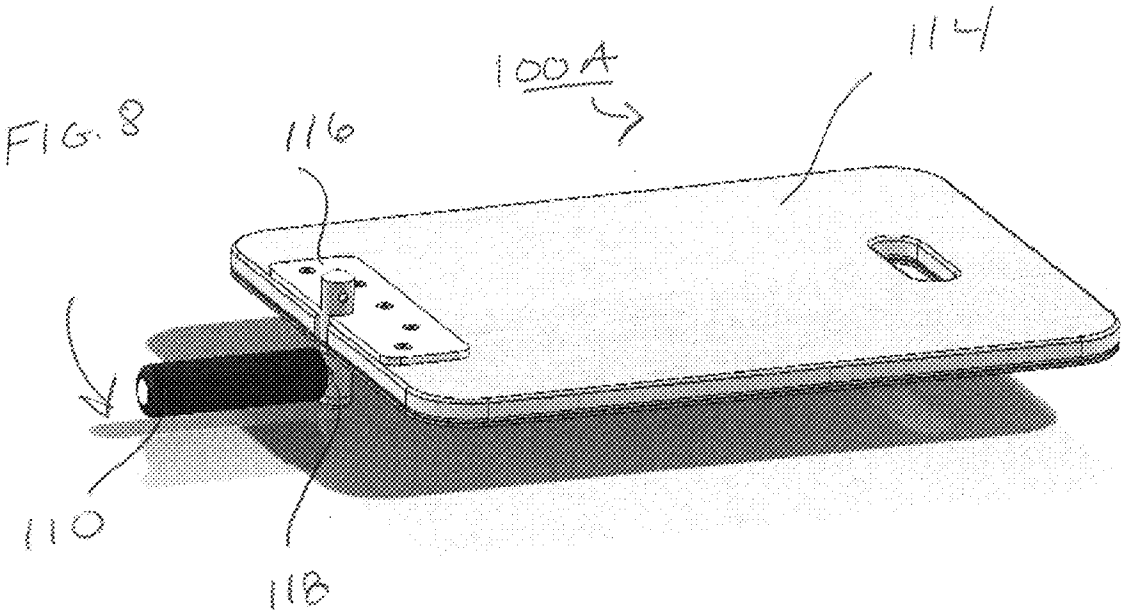
FIG. 8 is an isometric view of an alternative embodiment for use with a thin mattress, in this case without requiring a base connecting rod disposed between the base plate and the foot anchor rod.

A variation of this embodiment is shown in the isometric view of FIG. 8, where the base connecting rod is eliminated and the foot anchor rod is directly attached to the base plate. In this example, a sit-up apparatus 100A further comprises a bracket 116 that is used to directly attach foot anchor rod 110 to base plate 114. As shown, foot anchor rod 110 is disposed slightly below base plate 114, providing a sufficient spacing between a top surface of a thin pad that would cover base plate 114 (not shown) and foot anchor rod 110. Preferably, foot anchor rod 110 is attached to bracket 116 using a swivel coupling 118 so that it may be rotated against the bed when not in use (illustrated by the arrow in FIG. 8).

Figure 9:
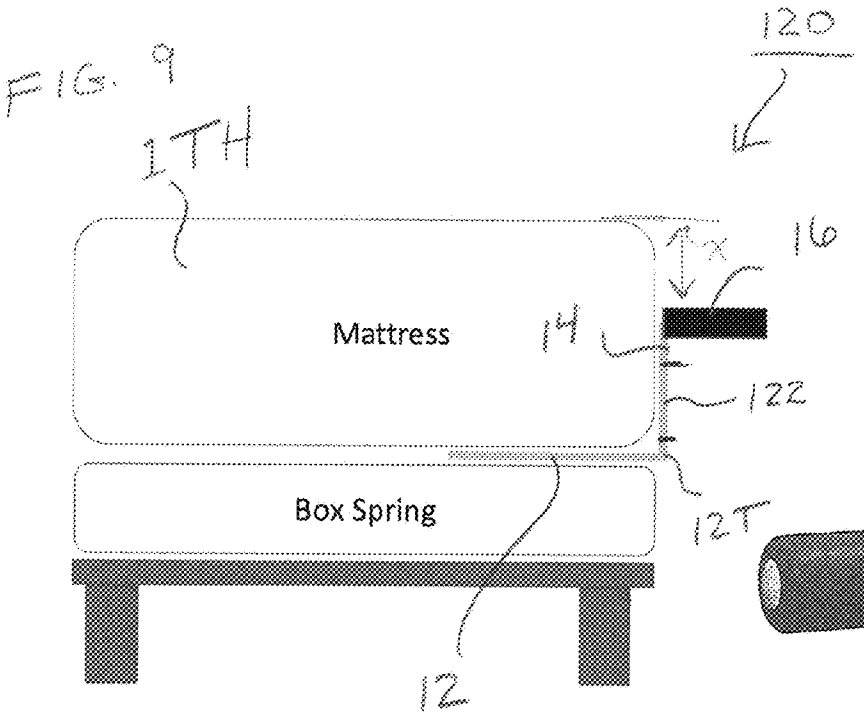
FIG. 9 is a diagram illustrating yet another situation, in this case where a thick mattress is used and the sit-up apparatus of the present invention is configured to include an extension member attached to the base connecting rod.

The sit-up apparatus of the present invention may also be used in combination with a relatively thick mattress. FIG. 9 illustrates this particular example. For situations where the adjustments to the length of the base connecting rod still do no bring the anchor rod to a desired position with respect to the top surface of the mattress, a sit-up anchor 120 as shown in FIG. 9 is formed to include an extension member 122 that is disposed in alignment with base connecting rod 14 and attached thereto in an appropriate fashion. The addition of extension member 122 thus places foot anchor rod 16 at the desired distance x below the top surface of mattress 1TH.

Figure 10:
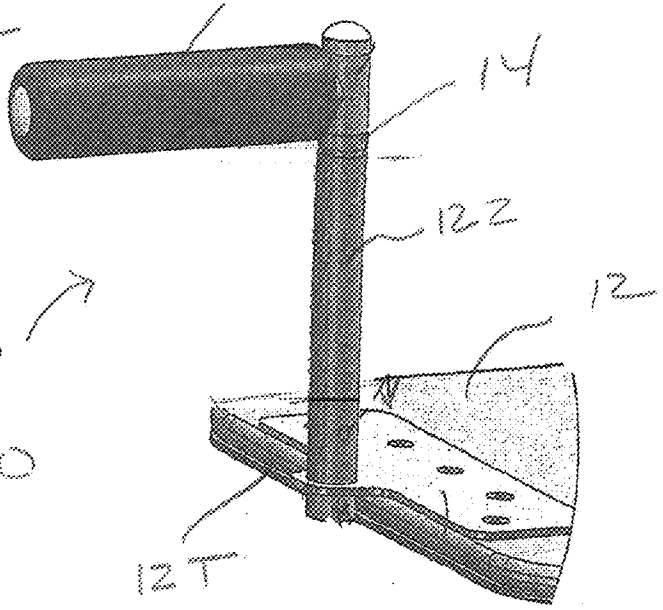
FIG. 10 is an enlarged, isometric view of a portion of a sit-up apparatus, showing the position of an extension member as attached to the base connecting rod.

FIG. 10 is an enlarged view of an end portion of sit-up apparatus 120, showing the placement of extension member 122 in place with base connecting rod 14. In one embodiment, a threaded attachment may be used to join extension member 122 to base connecting rod 14. Alternatively, a pair of double-sided spring clips may be attached to end terminations of extension member 122 and used to "click" member 122 in place. Other attachment methods may be used for this purpose, as long as the configuration is able to securely join the extension member to the base connecting rod in a removable manner.

As described above, although the present invention has been explained by way of limited examples, the present invention is not intended to be limited thereby, and any person having ordinary skill in the art to which the present invention pertains will be able to carry out various modifications that are considered to fall within the spirit and scope of the present invention. Indeed, the scope of the present invention is intended to be limited only by the metes and bounds of the claims as appended hereto.

What is claimed is:

1. A sit-up assistance apparatus comprising:

a base plate configured to be disposed and remain in place underneath a surface upon which an individual may rest, the base plate of dimensions sufficient to remain in place while being used;

a foot anchor rod coupled to the base plate and disposed to extend outward and away from the base plate, the foot anchor rod disposed slightly below the individual, wherein the shape of said foot anchor rod is adapted to receive force from a human foot and ankle in a manner such that the individual is able to rise to a sitting position by locating a foot underneath the foot anchor rod and pulling against with an ankle-area force, wherein said foot anchor rod is below a top of said surface upon which an individual may rest; and wherein the position of said foot anchor rod is localized to a foot-half of the surface upon which an individual may rest;

a base connecting rod disposed between and attached to both the base plate and the foot anchor rod;

an extension member attached to the base connecting rod to provide an adjustable spacing between the base plate and the foot anchor rod to adjust the placement of said foot anchor rod to accommodate a height of the surface upon which an individual may rest; and wherein the apparatus is configured to assist said individual in moving from a substantially prone position to a sitting position by providing leverage to a leg of said individual.

2. The sit-up assistance apparatus as defined in claim 1 wherein the foot anchor rod comprises an outer cushioned surface.

3. The sit-up assistance apparatus as defined in claim 1, wherein the foot anchor rod comprises a non-slip outer surface.

4. The sit-up assistance apparatus as defined in claim 1, wherein the base plate comprises a tubular structure.

5. The sit-up assistance apparatus as defined in claim 4 wherein the tubular structure further includes at least one section comprising with a non-slip outer surface.

6. The sit-up assistance apparatus as defined in claim 1 wherein the base plate comprises a solid structure.

7. The sit-up assistance apparatus as defined in claim 6 wherein the base plate further includes a grip opening for transport of the sit-up assistance apparatus.

8. The sit-up assistance apparatus as defined in claim 1 wherein the base plate exhibits a shape selected from the group consisting of: rectangular, square, oval, circular, and triangular.

9. The sit-up assistance apparatus as defined in claim 1 wherein the foot anchor rod is attached to the base connecting rod with a swivel connection, such that the foot anchor rod can be rotated between an open position and a closed position.

10. The sit-up assistance apparatus as defined in claim 9 wherein the swivel connection is configured to provide rotation of the foot anchor rod in a horizontal position, being parallel to the base when in the closed position.

11. The sit-up assistance apparatus as defined in claim 9 wherein the swivel connection is configured to provide rotation of the foot anchor rod in a vertical position, being perpendicular to the base when in the open position.

12. The sit-up assistance apparatus as defined in claim 1 wherein the base connecting rod is adjustable in length so as providing an adjustment in spacing between the base and the foot anchor rod.

13. The sit-up assistance apparatus as defined in claim 12 wherein the base connecting rod is an adjustable, telescoping rod.

14. The sit-up assistance apparatus as defined in claim 1 wherein said surface upon which an individual may rest is a mattress.

* * * * *